US012188751B2

(12) United States Patent
Gleaton et al.

(10) Patent No.: US 12,188,751 B2
(45) Date of Patent: Jan. 7, 2025

(54) WEAPON SYSTEM AMMUNITION CANISTER LID

(71) Applicant: The United States of America, as represented by the Secretary of the Navy, Crane, IN (US)

(72) Inventors: Daniel A. Gleaton, Bloomington, IN (US); Michael L. Holzmeyer, Bloomfield, IN (US); Paul C. Denesha, Jr., Bedford, IN (US); Max Melbourne Irwin, Bloomington, IN (US); Joshua F. Harding, Vincennes, IN (US); Eric Scott Gilham, Otwell, IN (US); Steven L. Backer, Jasper, IN (US)

(73) Assignee: The United States of America, Represented by the Secretary of the Navy, Washington, DC (US)

( * ) Notice: Subject to any disclaimer, the term of this patent is extended or adjusted under 35 U.S.C. 154(b) by 126 days.

(21) Appl. No.: 18/117,726

(22) Filed: Mar. 6, 2023

(65) Prior Publication Data

US 2023/0280138 A1 Sep. 7, 2023

Related U.S. Application Data

(60) Provisional application No. 63/316,563, filed on Mar. 4, 2022.

(51) Int. Cl.
*F42B 39/26* (2006.01)
*F42B 39/00* (2006.01)

(52) U.S. Cl.
CPC ..... *F42B 39/26* (2013.01); *F42B 39/002* (2013.01)

(58) Field of Classification Search
CPC ..... F42B 39/002; F42B 39/26; F41A 9/79
USPC ..... 206/3; 220/212, 810, 833, 836
See application file for complete search history.

(56) References Cited

U.S. PATENT DOCUMENTS

| | | | | |
|---|---|---|---|---|
| 5,206,454 A * | 4/1993 | Sanderson | F41A 9/79 | 89/33.14 |
| 6,336,552 B1 * | 1/2002 | Meier | B65D 43/163 | 206/815 |
| 7,546,794 B1 * | 6/2009 | Sarles | F41A 9/79 | 89/34 |
| 2008/0156808 A1 * | 7/2008 | Perry | B65D 51/20 | 220/849 |

* cited by examiner

*Primary Examiner* — Luan K Bui
(74) *Attorney, Agent, or Firm* — Naval Surface Warfare Center, Crane Division; Christopher Feigenbutz

(57) ABSTRACT

Provided is an ammunition container lid for use with an ammunition canister. The container lid includes a four-sided frame, a cover, a hinge assembly, a feed tray, a latch, and a Last Round Switch. The hinge assembly includes a repeating pattern of ammunition can hinge sections, feed tray hinge sections, and cover hinge sections with a rod holding the sections together. The lid has an integrated aerodynamic forward face that matches the curvature of the ammunition can. The feed tray assembly is incorporated into the container lid to prevent a reduction in ammunition can capacity. The cover and feed tray rotate on the same axis, thereby resulting in simplified, ergonomic operation, which eliminates the problems inherent in current designs that can open directly into the airstream during flight. The inventive lid does not require special tools for installation/removal and does not reduce ammunition can capacity.

16 Claims, 11 Drawing Sheets

WEAPON SYSTEM AMMUNITION CANISTER LID

CROSS-REFERENCE TO RELATED APPLICATIONS

The present application claims priority to U.S. Provisional Patent Application Ser. No. 63/316,563, filed Mar. 4, 2022, entitled "WEAPON SYSTEM AMMUNITION CANISTER LID," the disclosure of which is expressly incorporated by reference herein.

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 210,073 is assigned to the United States Government and is available for licensing for commercial purposes. Licensing and technical inquiries may be directed to the Technology Transfer Office, Naval Surface Warfare Center Crane, email: Crane_T2@navy.mil.

FIELD OF THE INVENTION

The field of invention relates generally to containers. More particularly, it pertains to an ammunition container lid for use with historical ammunition canisters.

BACKGROUND

It is known to provide various weapon systems on a variety of vehicles, including aircraft. With respect to helicopters, machine guns have been mounted within cabin areas, on window sills, and on external store supports. A key part of these weapon systems include the ammunition container, which are used to store ammunition and feed the weapon. Current ammunition containers that are known and disclosed in the art utilize a lid that feed and rotate on opposite axes, with one of them being in the forward direction. The ammunition can lids that are known and disclosed in the art present multiple problems to the operator. First, these prior art lids are designed to open directly into airstream during flight. Second, prior art lids and feed trays are independent of one another and open on two axes, one of which is directly opposed the airstream while in flight. As can be appreciated, this design creates unnecessary hazards to the operator, as the lid and/or feed tray can slam shut on the operator while in flight, thereby potentially causing injuries. As is shown from the above, there is a need for a new and improved ammunition can that affords improved safety to the operator while in use.

SUMMARY OF THE INVENTION

The present disclosure relates to an ammunition container lid for use with an ammunition canister. The container lid includes a four-sided frame, a cover, a hinge assembly, a feed tray, a latch, and a Last Round Switch. The hinge assembly includes a repeating pattern of ammunition can hinge sections, feed tray hinge sections, and cover hinge sections with a press-fit rod holding the sections together. The lid has an integrated aerodynamic forward face that matches the curvature of the ammunition can. The feed tray assembly is incorporated into the container lid to prevent a reduction in ammunition can capacity. The cover and feed tray rotate on the same axis, thereby resulting in simplified, ergonomic operation, which eliminates the problems inherent in current designs that can open directly into the airstream during flight. The inventive lid does not require special tools for installation/removal and does not reduce ammunition can capacity.

According to an illustrative embodiment of the present disclosure, it is an object of the invention to provide a new and improved ammunition container lid that has all the benefits of the prior art and none of the disadvantages.

According to a further illustrative embodiment of the present disclosure, it is an object of the invention to provide a new and improved ammunition container lid and feed tray that rotate on the same axis in the outboard direction.

According to a yet another illustrative embodiment of the present disclosure, it is an object of the invention to provide a new and improved ammunition container lid that does not open directly into the airstream during flight.

According to a yet another illustrative embodiment of the present disclosure, it is an object of the invention to provide a new and improved ammunition container lid that utilizes existing attachment points on ammunition can.

According to a yet another illustrative embodiment of the present disclosure, it is an object of the invention to provide a new and improved ammunition container lid that does not require special tools for installation/removal.

According to a yet another illustrative embodiment of the present disclosure, it is an object of the invention to provide a new and improved ammunition container lid that does not reduce ammunition can capacity.

According to a yet another illustrative embodiment of the present disclosure, it is an object of the invention provide to a new and improved ammunition container lid with a latch that is easy to operate one-handed with gloves.

According to a yet another illustrative embodiment of the present disclosure, it is an object of the invention to provide a new and improved ammunition container lid with an integrated aerodynamic forward face, matching the curvature of can.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Generally, provided is an ammunition canister lid for an ammunition canister comprising: a four-sided frame, a cover, a hinge assembly, a feed tray, a latch, and a Last Round Switch; wherein the four-sided frame attaches to the ammunition container at one or more ammunition can attachment points; wherein the hinge assembly comprises a repeating pattern of ammunition can hinge sections, feed tray hinge sections, and cover hinge sections with a rod holding the ammunition can hinge sections, the feed tray hinge sections, and the cover hinge sections together; wherein the hinge assembly attaches to the four-sided frame on one side; and wherein the cover and the feed tray rotate independently and on a same axis.

In an illustrative embodiment, the hinge assembly comprises a one-piece rod that secures the ammunition can hinge sections, the feed tray hinge sections, and the cover hinge sections together. In an illustrative embodiment, the hinge assembly comprises a first rod that secures a first set of ammunition can hinge sections, the feed tray hinge sections, and the cover hinge sections together, and a second rod that secures a second set of ammunition can hinge sections, the feed tray hinge sections, and the cover hinge sections together. In an illustrative embodiment, the Last Round Switch comprises an actuator, a steel flap, and an indicator; wherein the actuator is depressed by the steel flap that is in contact with ammo feeding through the feed tray; wherein once a quantity of the ammo has been depleted and is no longer pushing against the flap, the actuator extends and sends a signal to the indicator. In an illustrative embodiment, the ammunition canister lid further comprises an integrated aerodynamic forward face that matches the curvature of the ammunition canister. In an illustrative embodiment, the latch comprises a ball grip with a square spring. In an illustrative embodiment, the feed tray comprises a bottom surface that does not extend into the ammunition container envelope to prevent a reduction in ammunition can capacity.

Figure 1:
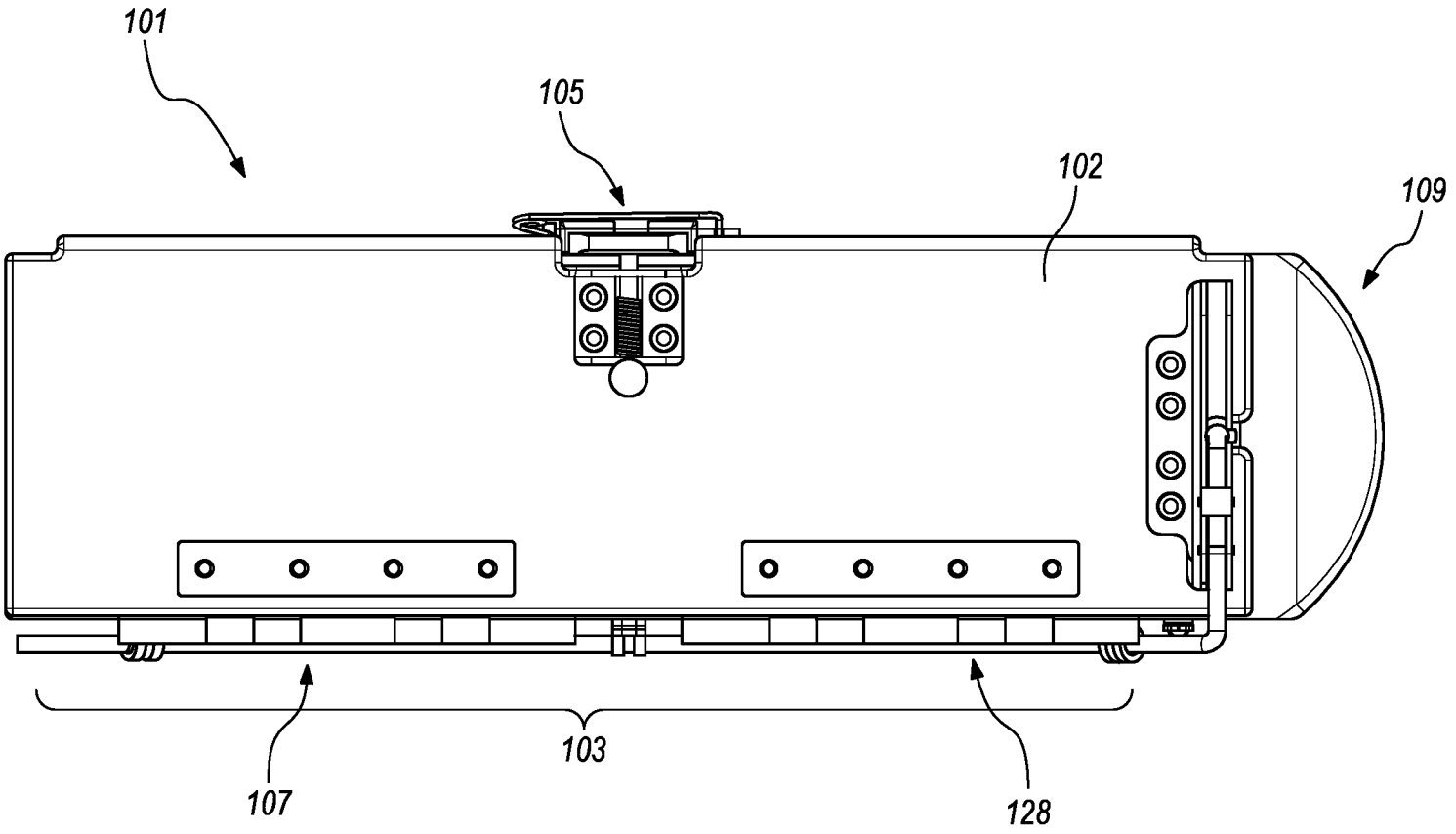
FIG. 1 shows an overhead view of the ammunition container lid.
Figure 2:
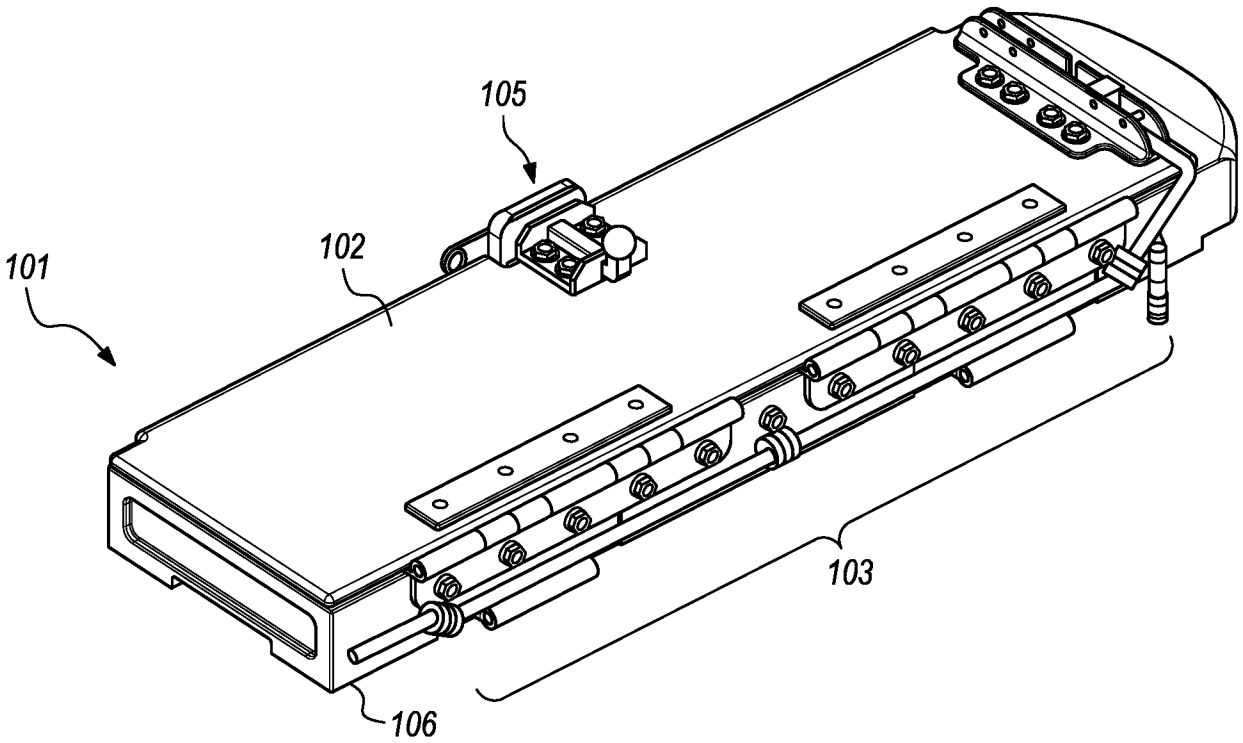
FIG. 2 shows a perspective view of the ammunition container lid.
Figure 3:
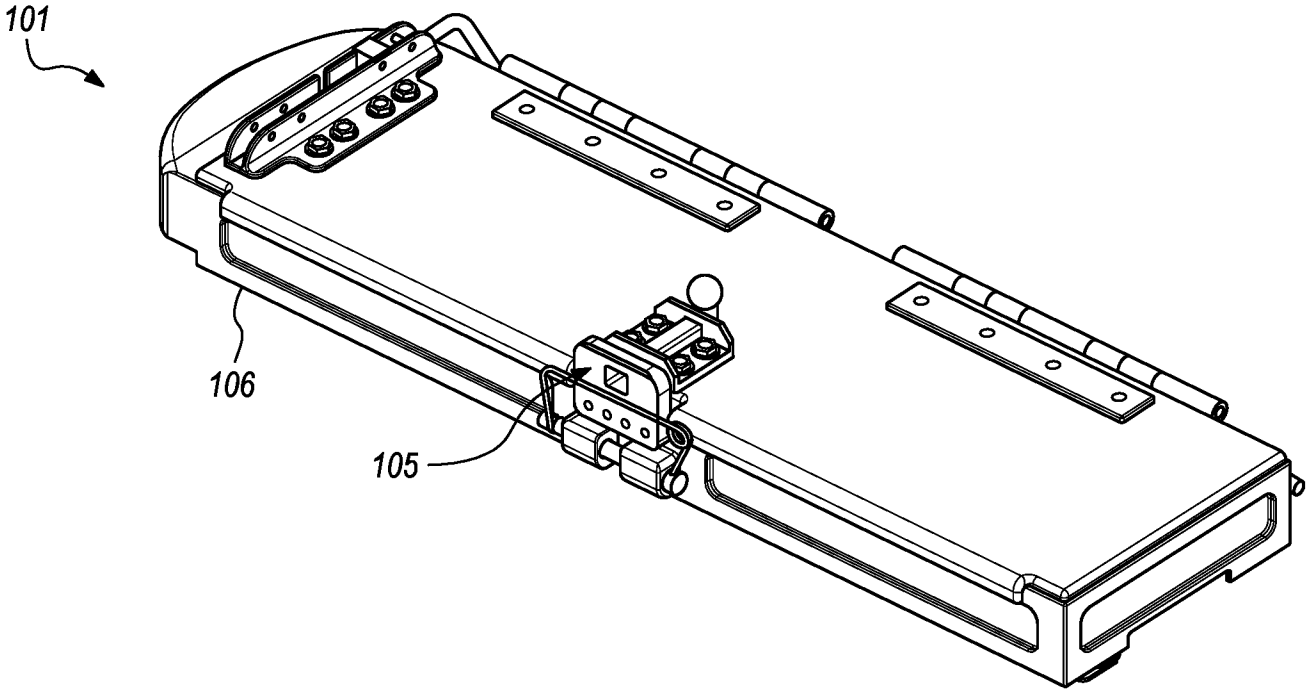
FIG. 3 shows a perspective view of the ammunition container lid.

FIG. 1 shows an overhead view of the ammunition container lid 101, and FIGS. 2 and 3 show perspective views of the ammunition container lid 101. The ammunition container lid 101 can be installed on existing historical ammunition cans with no modification required. The ammunition container lid 101 comprises a cover 102, a hinge assembly 103, a feed tray 104 (best viewed in FIG. 6A), and a latch 105. The cover 102 and feed tray 104 are attached to a four-sided frame 106 via the hinge assembly 103. In an illustrative embodiment, the hinge assembly 103 includes a first hinge section 107 and a second hinge section 108. In an illustrative embodiment, the container lid 101 includes an integrated aerodynamic forward face 109 that matches the curvature of the ammunition can. In an illustrative embodiment, the cover 102 and the feed tray 104 open independently and on the same axis using the hinge assembly 103. In an illustrative embodiment, the cover 102 and feed tray 104 rotate in the outboard direction. The cover 102 and feed tray 104 rotate on the same axis, resulting in simplified, ergonomic operation in flight, which eliminates the inherent problems with opening the lid and/or feed tray directly into the airstream during flight.

In one illustrative embodiment, the integrated aerodynamic forward face 109 matches the curvature of can. The designs that currently exist in the art are not aerodynamic, and therefore increase aerodynamic drag. Additionally, the rounded design of the container lid 101 reduces snag hazards. In an illustrative embodiment, the integrated aerodynamic forward face 109 comprises 0.25" rounds added to container lid 101 to reduce elbow hazard risk during gun operation. An additional advantage of the inventive lid is that it has a smaller footprint than currently existing ammunition container lids. In an illustrative embodiment, the underside is hollow for weight reduction.

Figure 4:
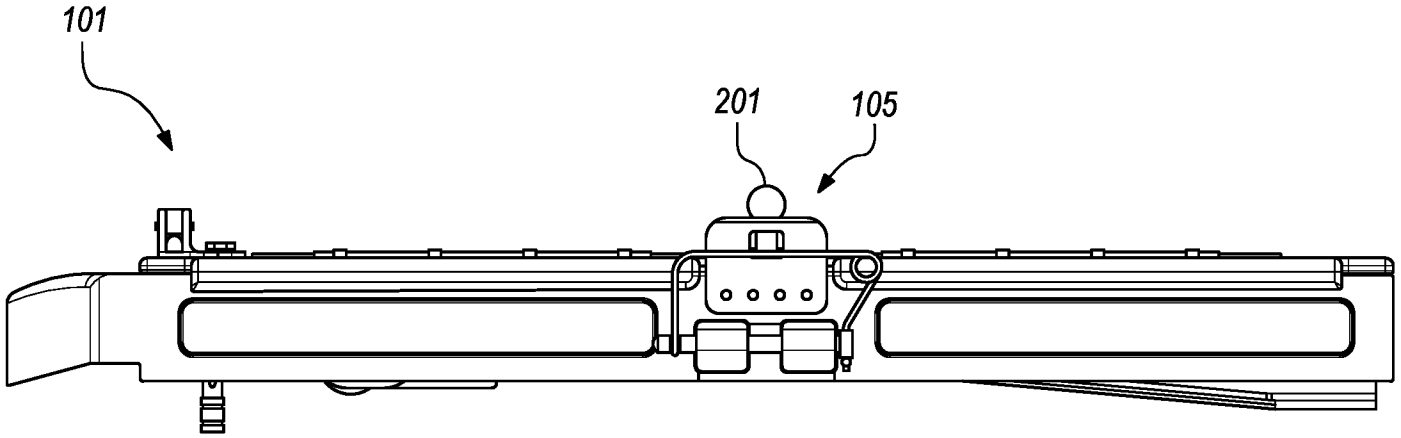
FIG. 4 shows a side view of the container lid and the latch.
Figure 5:
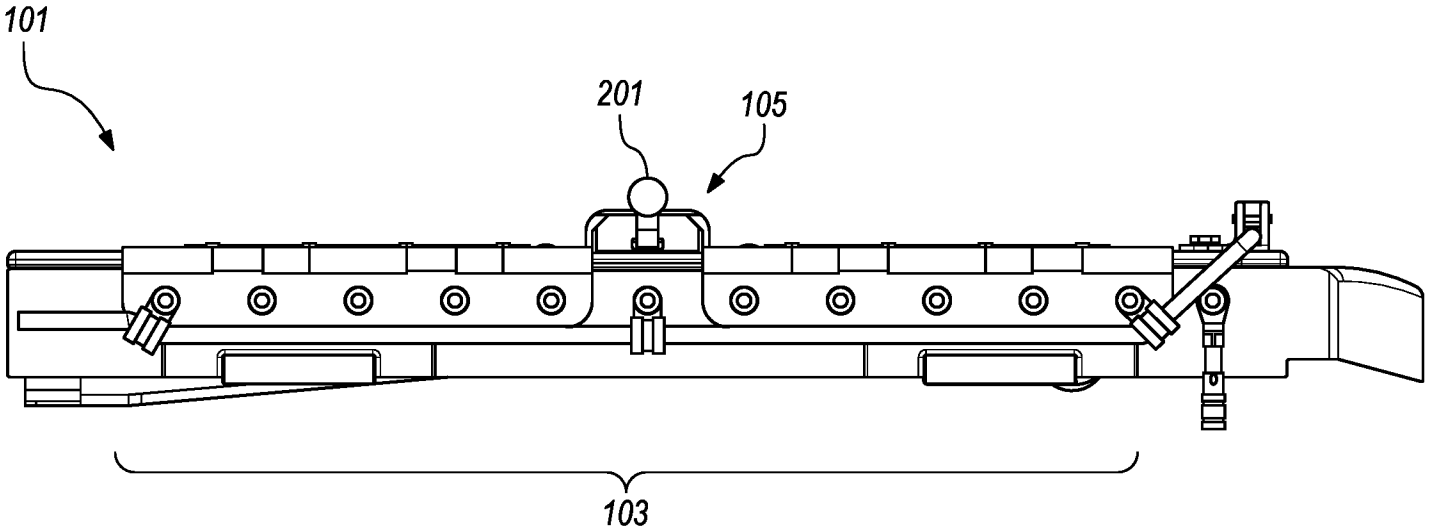
FIG. 5 shows a side view of the container lid, hinge, and the latch.

FIGS. 4 and 5 show side views of the container lid 101, the hinge assembly 103, and the latch 105. In an illustrative embodiment, the latch 105 comprises a ball grip 201 with a square spring. The latch 105 can be operated one-handed, with the latch 105 moving along one axis (i.e., no pull-and-rotate, just pull). In an illustrative embodiment, the ball grip 201 further improves ergonomics for user, allowing for one-handed operation, and even with gloves. The currently existing lids cannot be easily operated with one hand.

Figure 6B:
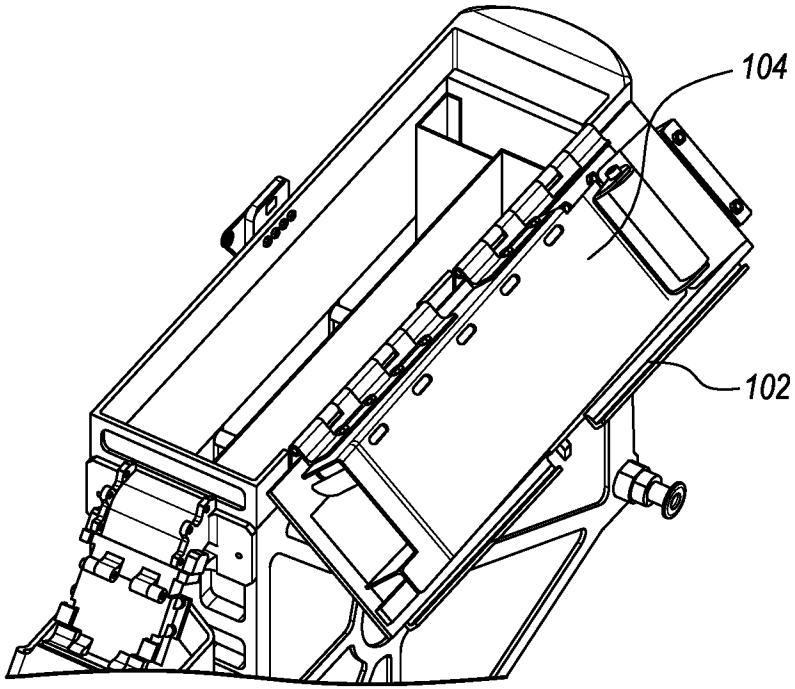
FIG. 6B shows a perspective view of the cover and the feed tray in an open position.
Figure 6A:
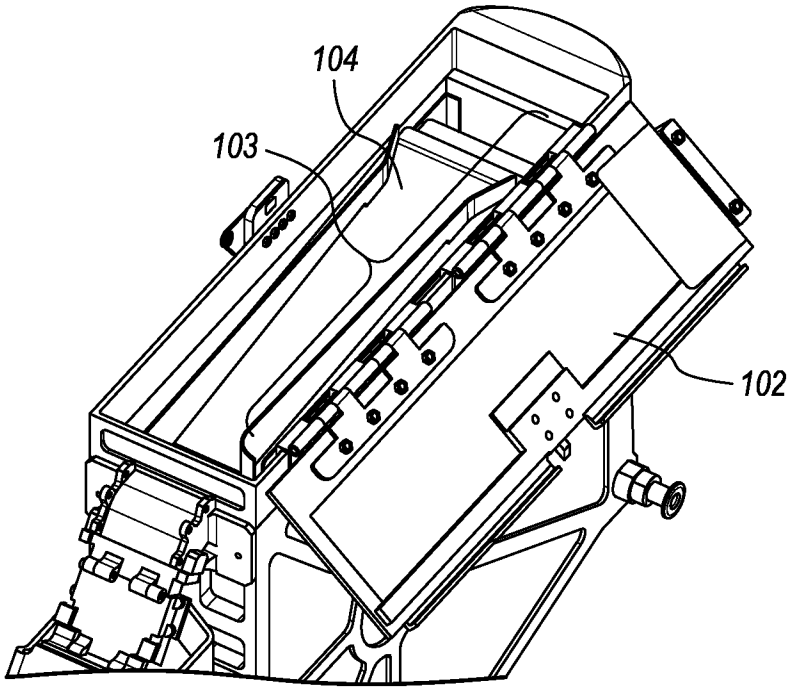
FIG. 6A shows a perspective view of the cover in an open position and the feed tray in a closed position.

FIG. 6A shows a perspective view of the cover 102 in an open position and the feed tray 104 in a closed position, and FIG. 6B shows a perspective view of the cover 102 and the feed tray 104 in an open position. In an illustrative embodiment, the cover 102 and feed tray 104 rotate on the same axis in the outboard direction, resulting in simplified, ergonomic operation in flight. As can be appreciated, lids and feed trays that open into the airstream can create unnecessary hazards to the operator. The inventive cover 102 and feed tray 104 opens/closes parallel to induced wind current from forward motion of aircraft, making it highly unlikely that it will slam shut based on weight and angle. FIG. 6A shows the cover 102 open and the feed tray 104 closed, while FIG. 6B shows both the cover 102 and feed tray 104 open. In an illustrative embodiment, the cover 102 rotates open to a maximum of 225° with a stop attached to the can. In an illustrative embodiment, the cover 102 rotates open to 237° without a stop.

Figure 7:
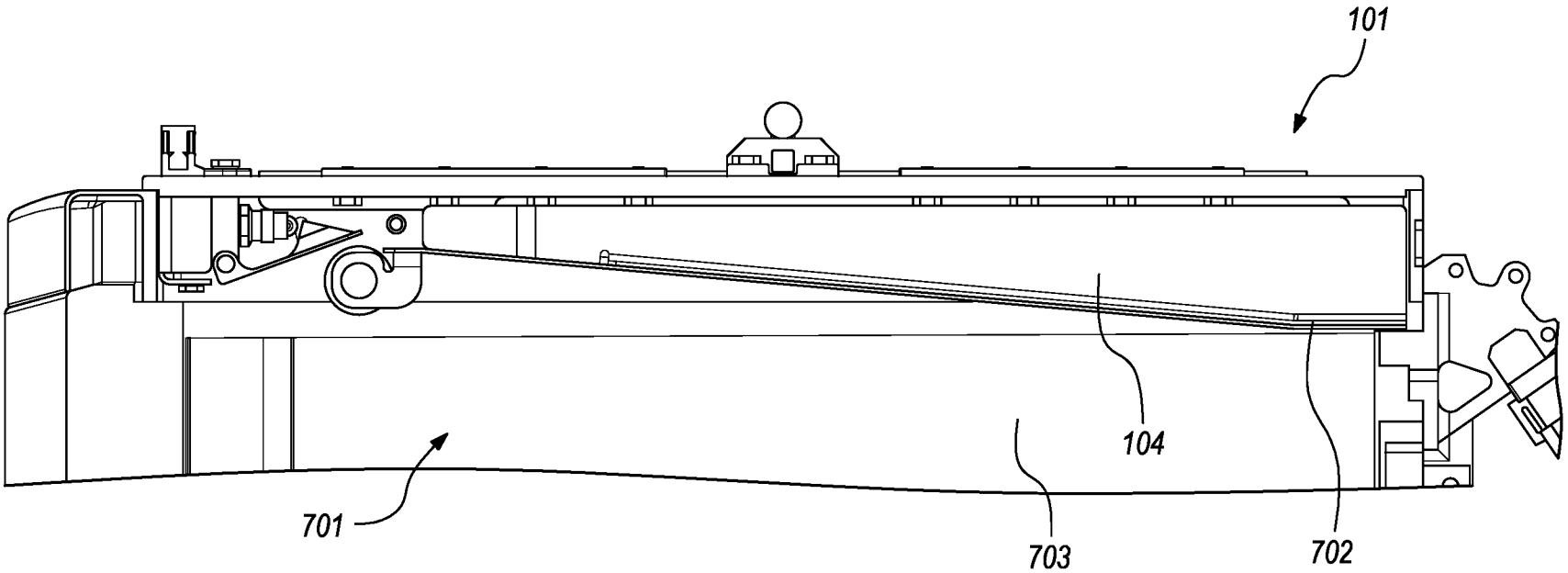
FIG. 7 shows a side cut-away view of the ammunition container lid and feed tray positioned on an ammunition container.

FIG. 7 shows a side cut-away view of the ammunition container lid 101 and feed tray 104 positioned on an ammunition container 701. In an illustrative embodiment, the ammunition container lid 101 utilizes existing attachment points on an ammunition can 701, and does not require the use of special tools for installation/removal. In an illustrative embodiment, the bottom surface 702 of the feed tray 104 does not extend into the envelope 703 of the ammunition container 701, thereby preventing a reduction in ammunition can capacity, which, in an illustrative embodiment is 2,700 rounds of 7.62×51 mm ammunition.

Figure 8:
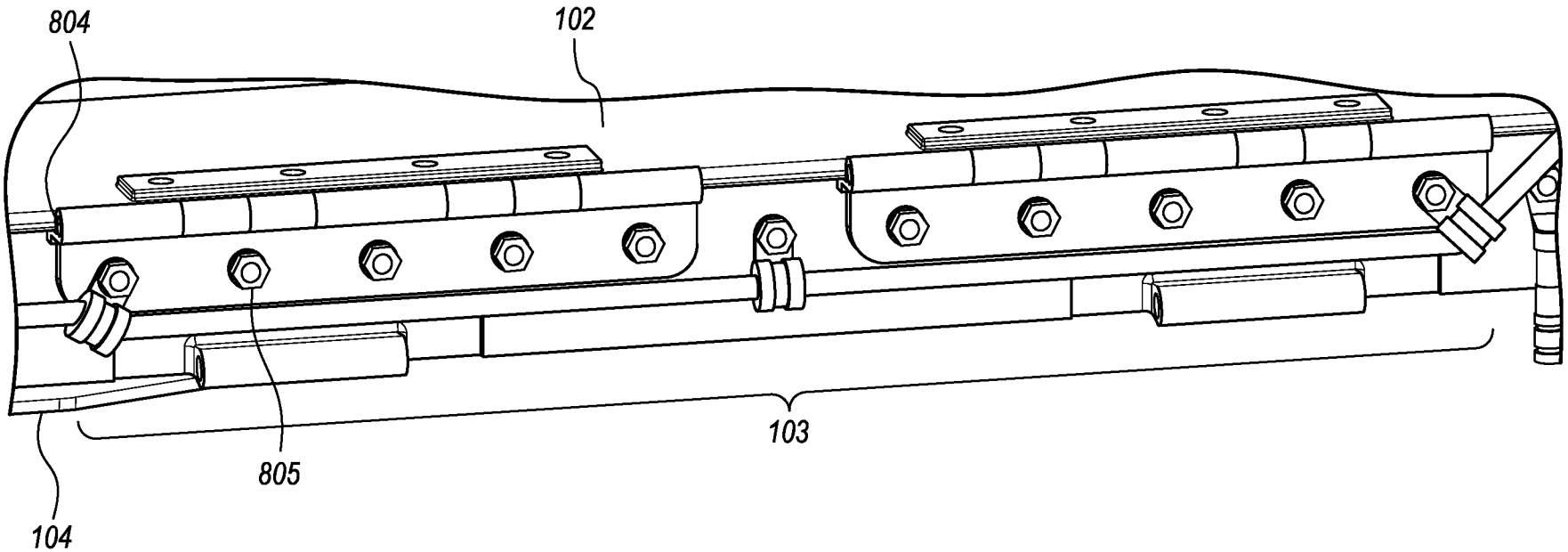
FIG. 8 shows a close-up view of the hinge assembly.
Figure 9:
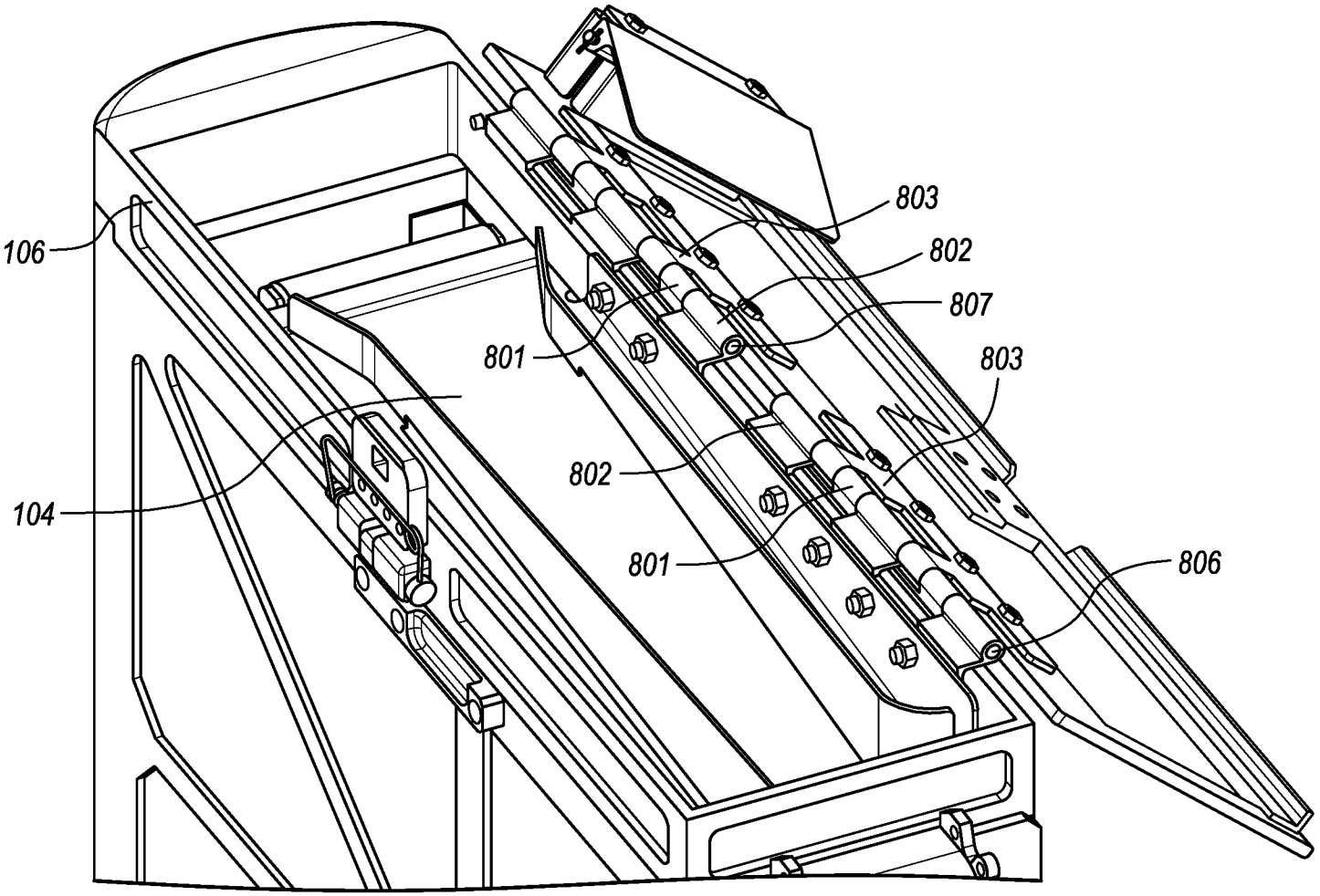
FIG. 9 shows a perspective view of the hinge assembly.

FIG. 8 shows a close-up view of the hinge assembly 103, and FIG. 9 shows a perspective view of the hinge assembly 103. The cover 102 and feed tray 104 are attached to the four-sided frame 106 via the hinge assembly 103. In an illustrative embodiment, the hinge assembly 103 comprises a repeating pattern of ammunition can hinge sections 801, feed tray hinge sections 802, and cover hinge sections 803 with a rod 804 holding the sections 801, 802, 803 together. The hinge assembly 103, combined with the cover 102 and feed tray 104 enable the cover 102 and feed tray 104 to operate independent of one another. In an illustrative embodiment, the cover 102 and feed tray 104 can both be closed, both be open, and the cover 102 can be open and the feed tray 104 can be closed. In an illustrative embodiment, the hinge assembly 103 attaches to the four-sided frame 106 on one side. In an illustrative embodiment, the hinge assembly 103 attaches to the four-sided frame 106 with bolts 805 that are secured with safety wire (not shown). In an illustrative embodiment, the rod 804 is a one-piece design that secures the sections 801, 802, 803 together. In an alternate embodiment, the hinge assembly 103 comprises a first rod 806 that secures a first set of sections 801, 802, 803, together, and a second rod 807 that secures a second set of sections 801, 802, 803 together.

Figure 10:
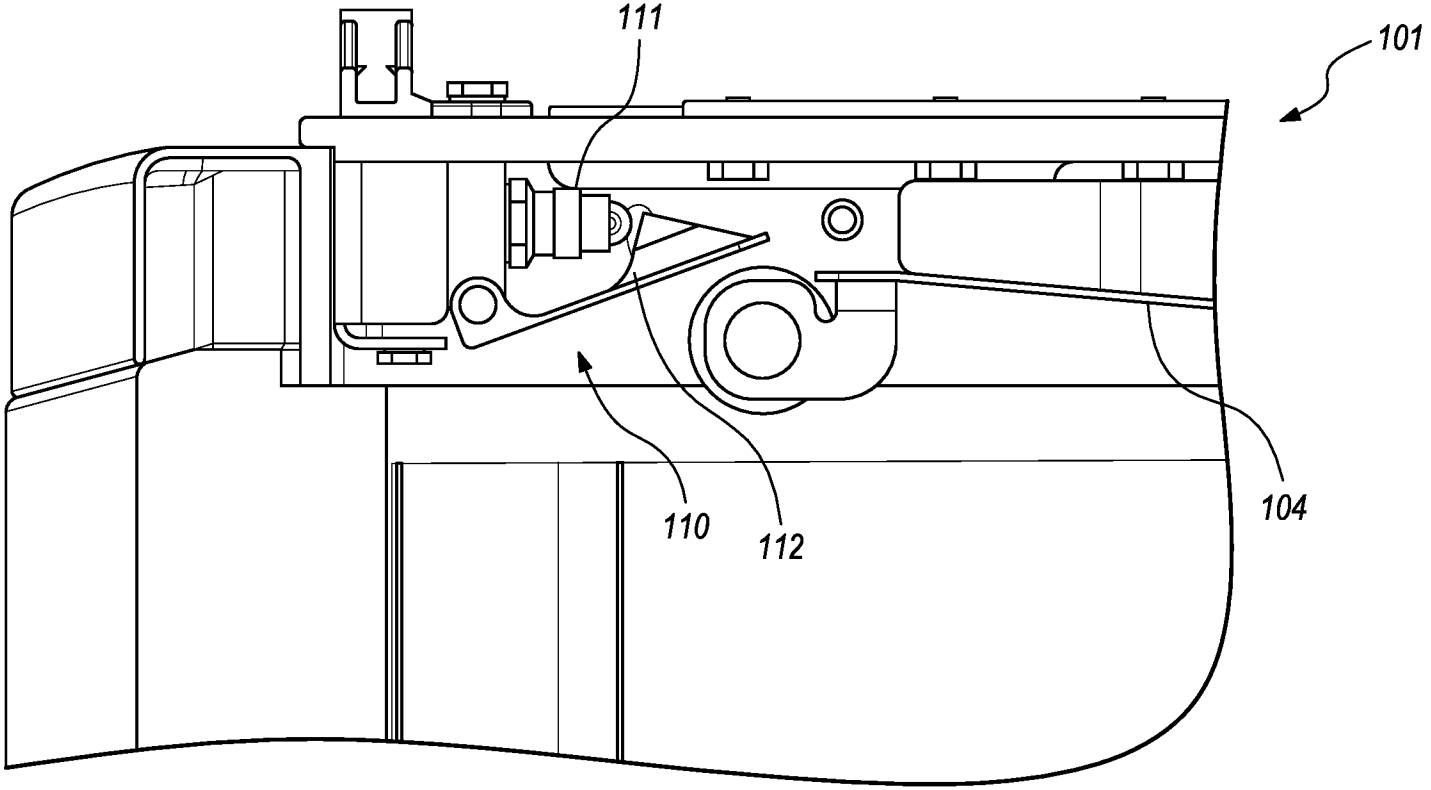
FIG. 10 shows a close-up view of the Last Round Switch.

FIG. 10 shows a close-up view of the Last Round Switch 110. In an illustrative embodiment, the Last Round Switch (LRS) 110 is incorporated into and entirely contained within the ammo can lid 101. During operation with a fully loaded ammo can, the LRS actuator 111 is depressed by a steel flap 112 in contact with ammo (not shown) feeding through the feed tray 104. Once most of the ammo has been depleted and is no longer pushing against the flap 112, the LRS actuator 111 extends, sending a signal to the weapon. This signal illuminates a light on the handle for the operator to see that they are almost out of ammunition.

Figure 11:
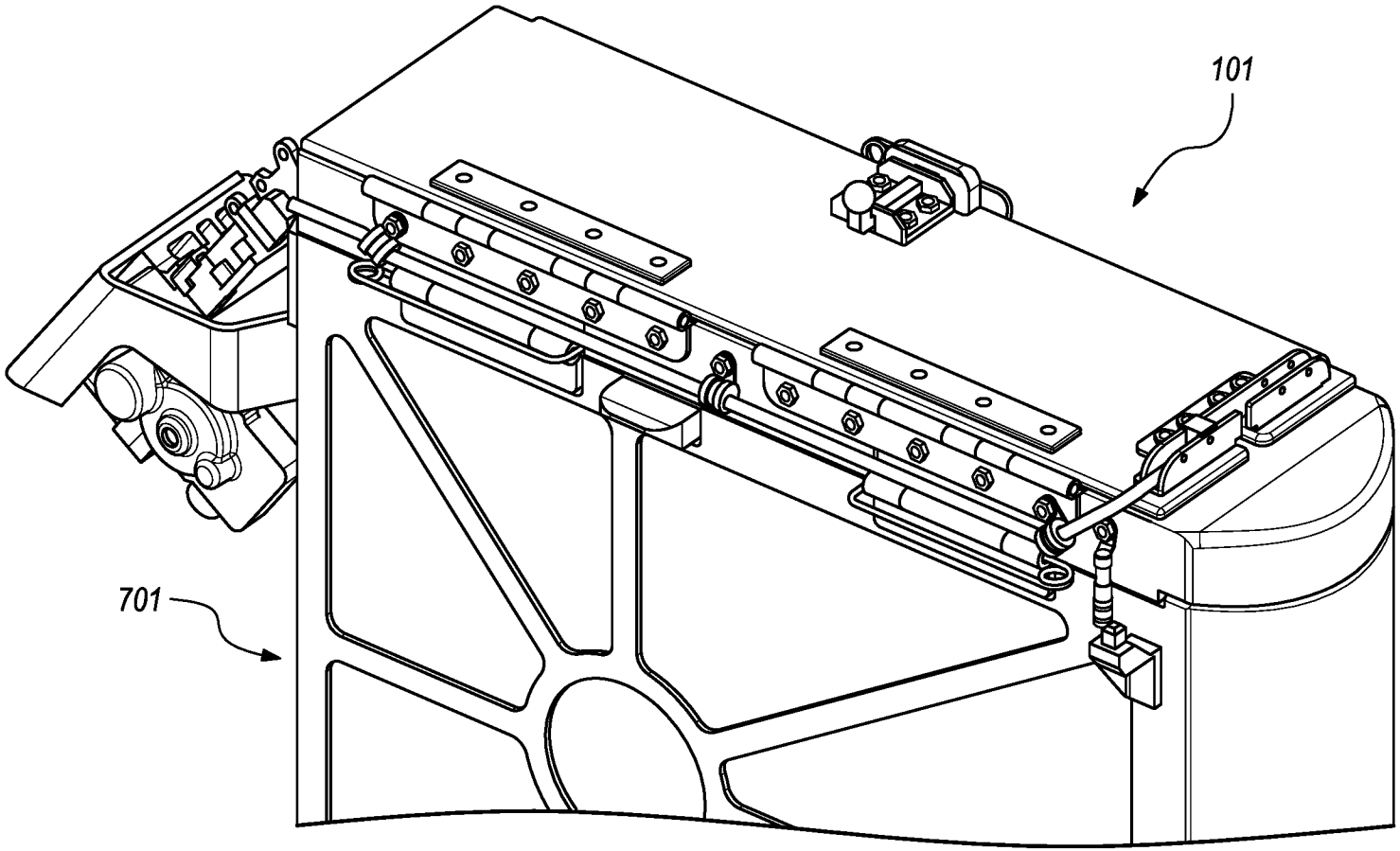
FIG. 11 shows a perspective view of the historical ammunition container with the ammunition container lid installed.

FIG. 11 shows a perspective view of a historical ammunition container 701 with the ammunition container lid 101 installed. In an illustrative embodiment, the inventive ammunition container lid 101 can be utilized with historical ammunition containers 701, such as those designed to hold 7.62×51 mm ammunition. In an illustrative embodiment, the ammunition container lid 101 can be adapted for use with other types of ammunition. In an illustrative embodiment, the ammunition container lid 101 can be utilized with the HH-60W Combat Rescue Helicopter (CRH), GAU-2C Weapon System, by the Air Force Materiel Command (AFMC), Air Force Life Cycle Management Center (AFLCMC), CRH Helicopter Program Office (WIH).

Although the invention has been described in detail with reference to certain preferred embodiments, variations and modifications exist within the spirit and scope of the invention as described and defined in the following claims.

The invention claimed is:

1. An ammunition canister lid for an ammunition canister comprising:

a four-sided frame, a cover, a hinge assembly, a feed tray, a latch, and a Last Round Switch;

wherein said four-sided frame attaches to said ammunition canister at one or more ammunition can attachment points;

wherein said hinge assembly comprises a repeating pattern of ammunition can hinge sections, feed tray hinge sections, and cover hinge sections with a rod holding said ammunition can hinge sections, said feed tray hinge sections, and said cover hinge sections together;

wherein said hinge assembly attaches to said four-sided frame on one side; and wherein said cover and said feed tray rotate independently and on a same axis.

2. The ammunition canister lid of claim 1, wherein said hinge assembly comprises a one-piece rod that secures said ammunition can hinge sections, said feed tray hinge sections, and said cover hinge sections together.

3. The ammunition canister lid of claim 1, wherein said hinge assembly comprises a first rod that secures a first set of said ammunition can hinge sections, said feed tray hinge sections, and said cover hinge sections together, and a second rod that secures a second set of said ammunition can hinge sections, said feed tray hinge sections, and said cover hinge sections together.

4. The ammunition canister lid of claim 1, wherein said Last Round Switch comprises an actuator, a steel flap, and an indicator;

wherein said actuator is depressed by said steel flap that is in contact with ammo feeding through said feed tray;

wherein once a quantity of said ammo has been depleted and is no longer pushing against said flap, said actuator extends and sends a signal to said indicator.

5. The ammunition canister lid of claim 1, further comprising an integrated aerodynamic forward face that matches the curvature of said ammunition canister.

6. The ammunition canister lid of claim 1, wherein said latch comprises a ball grip with a square spring.

7. The ammunition canister lid of claim 1, wherein said feed tray comprises a bottom surface that does not extend into said ammunition canister envelope to prevent a reduction in ammunition can capacity.

8. An ammunition canister lid for an ammunition canister comprising:

a four-sided frame, a cover, a hinge assembly, a feed tray, a latch, and a Last Round Switch;

wherein said four-sided frame attaches to said ammunition canister at one or more ammunition can attachment points;

wherein said hinge assembly comprises a repeating pattern of ammunition can hinge sections, feed tray hinge sections, and cover hinge sections with a one-piece rod holding said ammunition can hinge sections, said feed tray hinge sections, and said cover hinge sections together;

wherein said hinge assembly attaches to said four-sided frame on one side; and wherein said cover and said feed tray rotate independently and on a same axis.

9. The ammunition canister lid of claim 8, wherein said Last Round Switch comprises an actuator, a steel flap, and an indicator;

wherein said actuator is depressed by said steel flap that is in contact with ammo feeding through said feed tray;

wherein once a quantity of said ammo has been depleted and is no longer pushing against said flap, said actuator extends and sends a signal to said indicator.

10. The ammunition canister lid of claim 8, further comprising an integrated aerodynamic forward face that matches the curvature of said ammunition canister.

11. The ammunition canister lid of claim 8, wherein said latch comprises a ball grip with a square spring.

12. The ammunition canister lid of claim 8, wherein said feed tray comprises a bottom surface that does not extend into said ammunition canister envelope to prevent a reduction in ammunition can capacity.

13. An ammunition canister lid for an ammunition canister comprising:

a four-sided frame, a cover, a hinge assembly, a feed tray, a latch, and a Last Round Switch;

wherein said four-sided frame attaches to said ammunition canister at one or more ammunition can attachment points;

wherein said hinge assembly comprises a repeating pattern of ammunition can hinge sections, feed tray hinge sections, and cover hinge sections with a first rod that secures a first set of said ammunition can hinge sections, said feed tray hinge sections, and said cover hinge sections together, and a second rod that secures a second set of said ammunition can hinge sections, said feed tray hinge sections, and said cover hinge sections together;

wherein said hinge assembly attaches to said four-sided frame on one side;

wherein said cover and said feed tray rotate independently and on a same axis;

wherein said Last Round Switch comprises an actuator, a steel flap, and an indicator;

wherein said actuator is depressed by said steel flap that is in contact with ammo feeding through said feed tray; and wherein once a quantity of said ammo has been depleted and is no longer pushing against said flap, said actuator extends and sends a signal to said indicator.

14. The ammunition canister lid of claim 13, further comprising an integrated aerodynamic forward face that matches the curvature of said ammunition canister.

15. The ammunition canister lid of claim 13, wherein said latch comprises a ball grip with a square spring.

16. The ammunition canister lid of claim 13, wherein said feed tray comprises a bottom surface that does not extend into said ammunition canister envelope to prevent a reduction in ammunition can capacity.

* * * * *